United States Patent [19]

Schneider

[11] Patent Number: 4,962,870

[45] Date of Patent: Oct. 16, 1990

[54] DISTRIBUTOR FOR PASTY PRODUCTS WITH A DEFORMABLE PUMPING MEMBER AND A FLEXIBLE DISK EXPULSION VALVE CONNECTED TO THE PUMP ACTUATOR BY A CENTRAL BEARING LINK

[75] Inventor: Bernard Schneider, Sainte Menehould, France

[73] Assignee: Cebal, Clichy, France

[21] Appl. No.: 247,502

[22] Filed: Sep. 22, 1988

[30] Foreign Application Priority Data

Sep. 25, 1987 [FR] France ..... 87 13927

[51] Int. Cl.[5] ..... B65D 37/00

[52] U.S. Cl. ..... 222/207; 222/209; 222/213; 222/256; 222/378; 222/383; 222/389; 417/479

[58] Field of Search ..... 222/206, 207, 209, 213, 222/256, 257, 258, 262, 378, 380, 383, 389

[56] References Cited

U.S. PATENT DOCUMENTS

| | | | |
|---|---|---|---|
| 2,774,517 | 9/1955 | Teegardin et al. . | |
| 3,244,332 | 4/1966 | Rogers | 222/213 |
| 3,752,366 | 8/1973 | Lawrence, Jr. | 417/479 X |
| 3,874,563 | 4/1975 | Schwartzman | 222/213 |
| 3,986,644 | 10/1976 | Grogan et al. | 417/479 X |
| 4,139,311 | 2/1979 | Lorscheidt . | |
| 4,201,317 | 5/1980 | Aleff | 417/479 X |
| 4,651,904 | 3/1987 | Schuckmann | 222/383 |
| 4,771,925 | 9/1988 | Stöffler et al. | 222/207 |
| 4,807,784 | 2/1989 | Jupin et al. . | |

FOREIGN PATENT DOCUMENTS

| | | |
|---|---|---|
| 0221362 | 5/1987 | European Pat. Off. . |
| 0266284 | 5/1988 | European Pat. Off. . |
| 2581370 | 5/1985 | France . |

*Primary Examiner*—Andres Kashnikow
*Assistant Examiner*—Kenneth R. DeRosa
*Attorney, Agent, or Firm*—Dennison, Meserole, Pollack & Scheiner

[57] ABSTRACT

A distributor for pasty products having a sliding piston and a distribution head. The distribution head has a tubular, deformable pumping member, an actuator acting on the pumping member and an expelling valve. An upper end of an upper tube of the pumping member forms an annual end edge. The expelling valve has a flexible disk with a periphery kept in engagement with the end edge of the tube by a central bearing member of the disk. The bearing member is connected to the actuator, the flexible disk and the end edge of the tube.

15 Claims, 4 Drawing Sheets

DISTRIBUTOR FOR PASTY PRODUCTS WITH A DEFORMABLE PUMPING MEMBER AND A FLEXIBLE DISK EXPULSION VALVE CONNECTED TO THE PUMP ACTUATOR BY A CENTRAL BEARING LINK

BACKGROUND OF THE INVENTION

1. Field of the Invention

The present invention relates to the field of distributors for pasty products having a piston sliding tightly within a tubular body and passing up to a distribution head, as well as pumping means controlled by an actuator and expulsion valve or for closing a distribution passage or outlet for the pasty product. The term "pasty product" herein designates any product which can be distributed by such a distributor, no matter whether it is called a paste, a gel or a cream.

2. Description of Related Art

FR-A-2 577 076 describes a distributor in accordance with the above definition and with two embodiments. In the first embodiment of the bottom piston is provided with a return-preventing metal skirt and moves upwards under the effect of the vacuum caused by the discharge of the product from the chamber surmounting the piston, the underside of the piston being at atmospheric pressure. In the second embodiment the bottom piston is drawn upwards in stepwise manner towards the outlet port during successive uses of the distributor by a connecting rod coupled to the actuating lever, in such a way that the piston rises along the rod whenever the latter is driven in.

European patent application EP-A-213 048 248 (=FR-A No. 2 585 439) of the present Applicant describes a distributor with a sliding piston rising by vacuum action, as in the first aforementioned embodiment and which has a distribution head comprising:

pumping means constituted by a deformable tubular member having above its base fixed to the top of the tubular body a deformable cover or web and an upper tube;

an actuator having an outer tubular part fixed to the top of the tubular body and an inclinable central part connected to said fixed outer part, said inclinable central part carrying beneath a bearing web a distribution duct having a lateral outlet portion, as well as the bottom of a longitudinal shaft into which issues said outlet portion, said shaft tightly nesting the upper tube of the deformable tubular pumping member;

the upper tube of the pumping member terminates by a flexible upper lip, which is applied beneath the bearing web of the actuator, said flexible lip and said bottom surface of the bearing web respectively forming the flap and the seat of a valve for expelling the pasty product in the distribution duct towards the outlet port;

the distributor also comprising a valve for the suction of the pasty product from the tubular body into the deformable tubular member (or forcing back the product into said tubular member) through orifices at the top of the tubular body, said valve being constituted by a lower flexible tubular lip of said tubular member and by a central bearing surface of the top surface of said top.

With distributors of the aforementioned type and with a modified suction valve, it has been found that the force for distributing the pasty product and which has to be exerted on the actuator bearing web was very high, namely 2.5 kg in place of the desirable 1.5 kg and in this case with a return time to the initial position or cycle time of 2 to 3 seconds, which is acceptable. In general terms with the tested distributors, it has been found that the expulsion forces were excessive, as were the return times.

Summary of the Invention

The invention is concerned with a means for reducing the expulsion force and also a means for reducing the return time or cycle time of the distributor.

The invention relates to a pasty product distributor, such as is known from EP-A-0213048 and which comprises:

(a) a tubular body and a piston for tightly sliding in the tubular body passing towards a distribution head;

(b) said distribution head, fixed to the tubular body has at least:

pumping means for the pasty product, incorporating at least in addition to the said sliding piston a deformable tubular pumping member, a valve for expelling the pasty product from said pumping member into a distribution duct and an actuator acting on said pumping member; said pumping member having above its base fixed with respect to the tubular body a deformable part and an upper tube, whilst the expulsion valve has a member constituted by the upper end of said upper tube of said pumping member;

the distribution duct for the pasty product follows on to said pumping member.

According to the invention, said upper end of the upper tube of the deformable pumping member consists of an annular end edge and the expulsion valve comprises a flexible disk, whose periphery is kept bearing against the end edge of the tube by a central bearing means of said disk, said bearing means being linked with the actuator, said flexible disk and said end edge of the tube thus respectively constituting the flap and the seat of said expulsion valve.

It has been found in tests, on which comments will be made hereinafter, that such an expulsion valve greatly reduced (1.5 to 2 times) the distribution force for the pasty product compared with an expulsion valve of the type described in EP-A-0213048. In order to at least explain this surprising result, it has been found that in the case of the prior art valve, the pasty product has a laminar passage between the flexible upper lip of the upper tube of the pumping member and the bearing web of the actuator beneath which said lip bears, whereby said flexible lip, which is made thinner at its end, has a thick root-type section, which reinforces its application pressure. In the case of the novel expulsion valve, there is a direct passage of the pasty product between the upper end edge of the pumping member and the periphery of the flexible disk forming the flap and the height of the peripheral passage gap obtained for a given expulsion force is a function of the thickness of the flexible disk and the flexibility of its material, which makes it possible to modify the opening force or the width of said passage gap by changing said material and/or changing said thickness.

In practice, the central bearing means of the flexible disk is advantageously a longitudinal rod, whose lower end bears on the disk or is linked therewith, the top of said rod being maintained by a centring means carried by the actuator, e.g. a small tube of the bottom of the web of the actuator in which is fitted the top of the rod or reliefs having the same function.

Preferably, for the mass production of the distributor, the flexible disk and its longitudinal bearing rod are integral with the tubular pumping member, typically forming a moulded part involving a single operation, whilst the flexible disk is then connected thereto within the upper tube by flexible connecting means, e.g. flexible retaining rings following on to a short central rod carried by the bottom of the disk. In the complex pumping member obtained and which in itself constitutes a second object of the invention, the arrangement of the flexible connecting means is such that it is possible to maintain the periphery of the flexible disk tightly bearing against the pasty product on the end edge of its upper tube by acting on the longitudinal bearing rod thereof.

The tubular pumping member in its various forms is preferably made from one of the following materials: thermoplastic polymers, silicone resins, natural rubber and artificial rubbers. In the case of the complex pumping member, the flexible disk, outside its central zone carrying the longitudinal bearing rod and, underneath, a connecting means to the upper tube, a typical thickness between 0.15 and 0.45 mm.

According to a preferred embodiment the novel expulsion valve of the distributor according to the invention has been associated with a suction valve described in an as yet unpublished French patent application of the Applicant filed on 13.10.1986 under No. 86-14348. The tubular body of the distributor then has a top carrying a passage orifice surrounded by an annular surface forming the seat of a suction valve for the pasty product in the compression chamber, which is defined by the tubular pumping member, the flap of said valve being constituted by an upper web, whose annular rim or border is sealingly applied to said annular surface in the valve closing position, and an underlying portion engaged in said passage orifice and provided in its lower part with one or more retaining reliefs of overall diameter exceeding by 0.4 to 2 mm the diameter of said passage orifice.

This arrangement, in which a deformable chamber or a compression chamber of reduced volume is located between an intake or suction valve and a discharge or expulsion valve, is known in principle and permits operation by compressions followed by expansions leading to the suction of the pasty product and the sliding bottom piston.

As the structure of the deformable tubular chamber equipped with its valves has an influence both on the expulsion force of the pasty product and on the return or cycle time of the distributor, defined by the return time of the actuator to its starting position, the present invention is concerned with the suction valve and to bringing about a better compromise between the expulsion force and the return time. The novel valve developed and which facilitates the suction of the pasty product into the compression chamber has a surprising influence on the return or cycle time, as will be revealed by the tests.

The underlying portion of the flap of said novel suction valve differs from the corresponding portion of the prior art valve with respect to a fundamental point. It has spaced reliefs, whose outer longitudinal edges serve as means for guiding the flap in the passage orifice of the top of the tubular body, said reliefs permitting the passage of the pasty product between them, whilst the overall diameter of these reliefs is smaller by 0.3 to 1.5 mm than the diameter of the passage orifice. The passage of the pasty product through the flap is then multiradial, whereas in the case of the prior art valve the product can only pass round the cylindrical underlying portion of the flap between said portion and the passage orifice. The means for retaining the underlying portion of the flap according to the invention preferably consist and in particular for moulding, of a substantially circular retaining ring carried by the lower part of the outer edges of the spaced reliefs. According to an advantageous configuration for the passage of the pasty product through the suction valve, the upper web of the flap then has a central hollowed-out zone, the bottom of said central zone being substantially at mid-height of the passage windows for the pasty product through the flap defined by the annular rim of the web of the flap, the spaced reliefs and the circular retaining ring. The retaining ring preferably has an external diameter 0.5 to 1 mm larger than the diameter of the passage orifice at the top of the tubular body and the outer longitudinal edges of the spaced reliefs of the flap preferably have an overall diameter smaller by 0.3 to 0.8 mm than the diameter of the passage orifice.

As described for the suction valve of EP-A-0213048, the suction valve described hereinbefore can be injection moulded at the same time as the top of the tubular body on the skirt of the latter, the circular retaining ring of the valve then being connected to the orifice on the top by a reduced thickness breakable ring. The ring is broken after mould removal and the circular retaining ring is forced through the passage orifice.

The different forms of the invention are more particularly used in each of the three distributor types described in the examples and of which two have been covered by tests.

Moreover, for all the distributors according to the invention, whose sliding piston has an upper, widened, flexible lip sliding within the skirt of the tubular body, by ensuring a seal for the pasty product, a rigid median part set back with respect to the inner surface of the skirt and a lower, semi-rigid, widened guide end sliding with a limited clearance or with slight force within said skirt, the tubular body preferably comprises air leak means during the insertion of said piston into said body up to contact with the pasty product contained therein and consisting of a transverse internal relief located at the bottom of said cylindrical circular skirt and having a minimum internal diameter smaller by 0.3 to 1.5 mm than the internal diameter of said skirt, as well as in a widened inlet zone of said relief with an internal diameter decreasing from an engagement diameter at least equal to the external diameter in the free state of said flexible upper lip of the piston up to said minimum internal diameter of said relief, the external diameter of said median part of the piston being smaller by at least 0.3 mm than said minimum internal diameter of said relief. The surprising effect of said relief, which has not yet been disclosed, is described in the Applicant's French patent application 86-15443 of 3.11.1986.

ADVANTAGES

The expulsion valve according to the invention, whose flexible disk is curved slightly in umbrella-like manner has numerous embodiments in the form of several parts or in one piece with the tubular pumping member. It permits the easy regulation of the opening force or the grip of the passage gap of said valve.

The suction valve preferably associated therewith surprisingly makes it possible to reduce the return time to the rest position of the distribution head, particularly when the search for a low distribution force has made it necessary to choose a tubular pumping member with a weak spring effect.

A description will now be given successively of 3 distributor types to which the present invention more particularly applies, as well as to comparison distributors, the tests demonstrating the effect of the novel expulsion valve and the effect of the novel suction valve.

DESCRIPTION OF THE PREFERRED EMBODIMENT

Similar members having the same function are designated by the same references.

Figure 1:
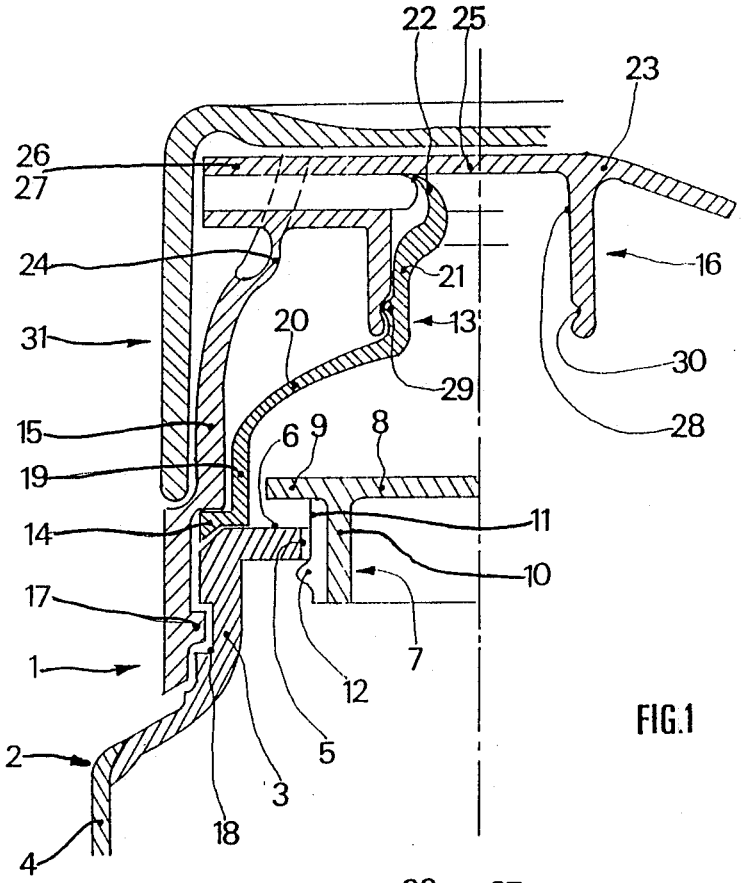
FIG. 1 shows a first control or comparison distributor with a tilting or rocking actuator, provided with a known expulsion valve and a suction valve, as used in previous experiments and as shown in copending application Ser. No. 102,552 filed Sept. 29, 1987, and now U.S. Pat. No. 4,807,784. The inclinable central part of the actuator being represented in axial section, while the other members up to the top of the tubular member are represented in axial, longitudinal half-section.
Figure 6:
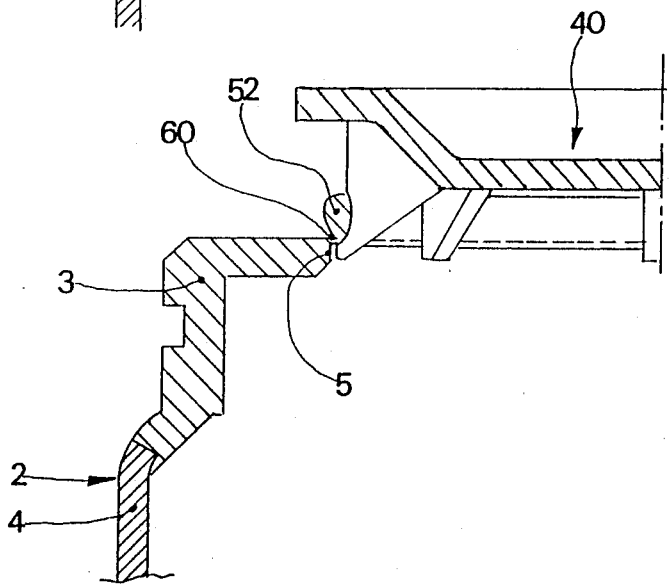
FIG. 6 shows a suction valve according to the invention in the crude state following injection moulding in a longitudinal axial half-section.

The first control distributor 1 (FIG. 1), used in the tests (case a) firstly comprises a HDPE tubular body 2 having a top 3, moulded on the cylindrical skirt 4 of external diameter 35 mm and thickness 1 mm and also made from HDPE, said top 3 having in its centre a diameter 22 mm central orifice 5 with on the upper periphery of said orifice 5 a planar annular surface 6 serving as a seat for the suction valve 7. The latter has a sealing web or cover 8, whereof the annular rim 9 is sealingly applied to the annular surface 6 and an underlying cylindrical portion 10 without a lateral opening carrying longitudinal guide reliefs 11 of overall diameter 20.5 mm and transverse retaining bosses 12 of circumscribed cylinder diameter 23.5 mm. The retaining bosses 12 have been forced through the orifice 5, the valve 7 being moulded at the same time as the top 3 with a breakable connecting ring, in accordance with the principle described hereinafter (FIG. 6). The axial travel of valve 7 in orifice 5 is 3 mm.

The deformable tubular pumping member 13 is fixed by its lower border 14 to the top 3 of tubular body 2 with locking between said top 3 and the outer skirt 15 of actuator 16, the rib 17 of said skirt 15 being ratched in the circular groove 18 of top 3. The moulded polyester ether pumping member 13 has successively above its lower border 14 a lower tube 19, a deformable, thickness-reduced, dome-shaped web 20 of thickness 0.9 mm, an upper tube 21 terminating by a flexible, widened, upper lip 22 of thickness 0.2 mm at its end. Actuator 16 has an inclinable central part 23 connected to its fixed outer skirt 15 by a deformable tab 24 constituting a flexible articulation and said inclinable part 23 has a bearing web 25 and, beneath the latter, a distribution duct 26 having an outlet portion 27, as well as the bottom of a longitudinal shaft 28 carried by web 25, the outlet duct 27 issuing into said shaft 28. The upper tube 21 is fixed in shaft 28 by the ratching of its outer rib 29 in a groove 30 on the bottom of said shaft 28. The flexible upper lip 22 consequently, in the inoperative position, is tightly applied to the bottom surface of the bearing web 25. A cap 31 can also be placed on the distribution head and then bears on a border or rim of the outer skirt 15.

Figure 5:
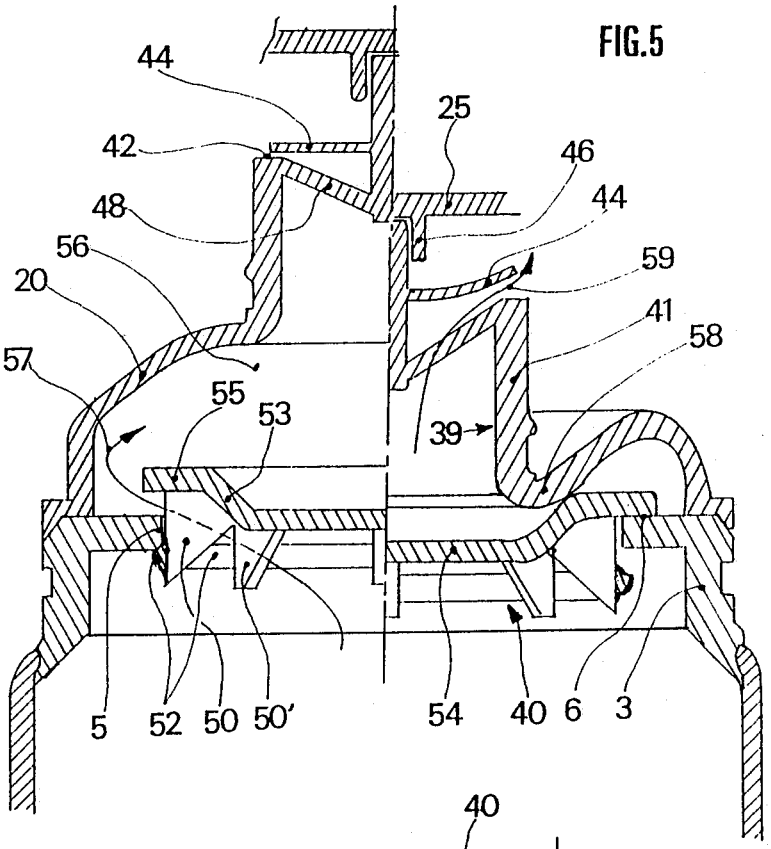
FIG. 5 shows the same tubular pumping member in position in the distributor, in two axial half-sections respectively in the suction phase and in the expulsion phase of the pasty product.

The bearing of actuator 16 leads to a deformation of the pumping member 13 similar to that of FIG. 5, the closing of valve 7, as well as the compression of the pasty product contained in member 13 and its expulsion by passage between web 25 and the flexible lip 22, followed by its escape through the outlet duct 27.

Figure 2:
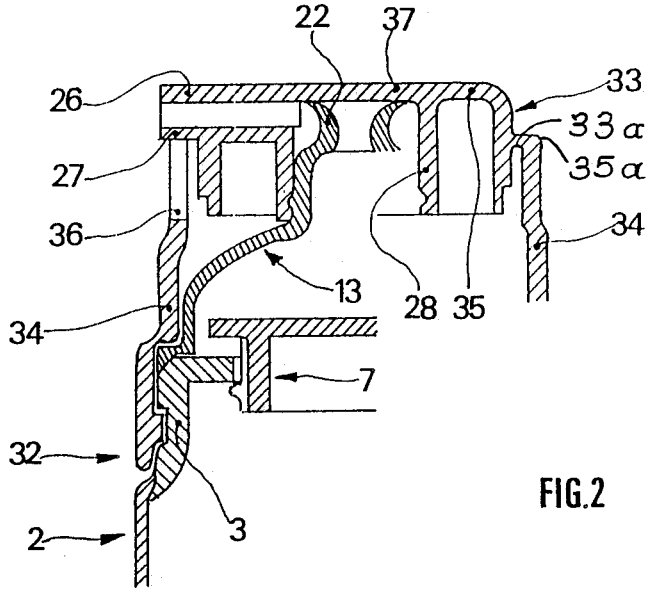
FIG. 2 shows in a similar way a second control distributor with an axial plunger and lateral distribution.

The second control distributor 32 (FIG. 2) only differs from the first distributor 1 by its actuator 33 described in the as yet unpublished French patent application of the Applicant filed on 23.1.1987. Actuator 33 has an outer tubular part 34 fixed by ratching on the top 3 of the tubular body 2 and an axial plunger 35, initally connected to the tubular part 34 by breakable bridges 35*a*, said plunger 35 being sealingly fixed by its shaft 28 to the tubular pumping member 13, as in the first distributor 1. Therefore the pumping member 13 constituting elastic spring effect means cooperating with plunger 35 and the tight fixing means 28, 29 permitting the rotation of the shaft 28 around member 21, plunger 35 being rotatable within the outer tubular part 34 and can axially slide in positions where said tubular part 34 permits its driving in. The distribution duct 26 of plunger 35 has in this case an outlet portion 27 with a lateral outlet, which constitutes its lateral drive-in abutment and the outer tubular part 34 has three cutouts such as 36 permitting the engagement and a chosen insertion or driving in of the lateral abutment 27 and therefore of plunger 35, as well as an upper edge 33*a* preventing the driving in of the plunger when the lateral abutment 27 surmounts it. With regards to the expulsion force (force on the actuator) and the return or cycle time of the distributor, the plunger 35 only differs from the inclinable part 23 of distributor 1 by its bearing web 37 and its axial drive-in mode. Its distribution duct 26 and shaft 28, as well as its fixing to the pumping member 13 have the same geometry as in the distributor 1 and the sliding skirt 38 of plunger 35 in the outer tubular part 34 has no affect on the studied problems.

Figure 3:
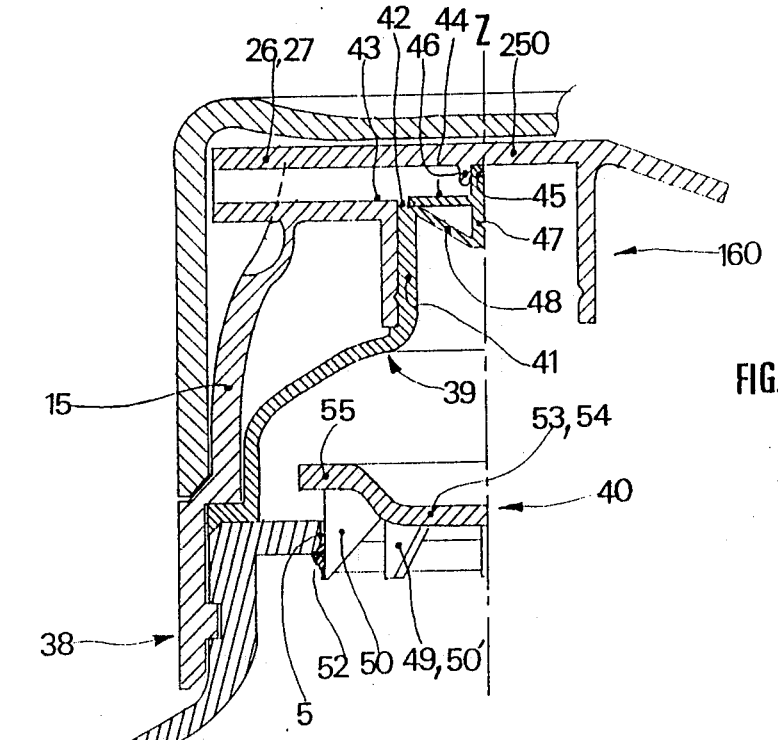
FIG. 3 shows in the same way a first distributor according to the invention, equipped with novel expulsion and suction valves and with a rocking actuator.
Figure 4:
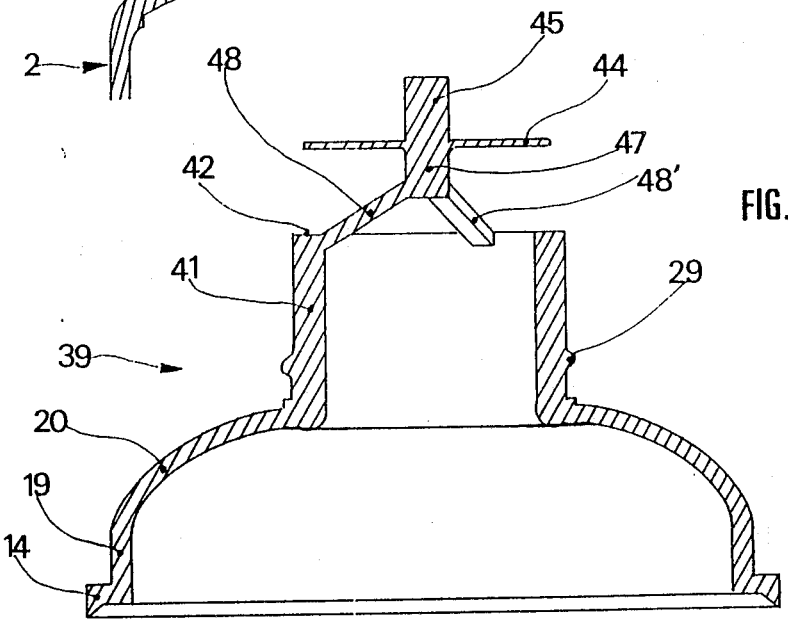
FIG. 4 shows the deformable tubular pumping member of said distributor, with the integral expulsion valve according to the invention in axial section.

The first distributor according to the invention 38 (FIG. 3) only differs from the first control distributor 1 by its pumping member 39, shown separately in FIG. 4 and its suction valve 40. In a different manner compared with the structure of the expulsion valve 22 and 25 of distributor 1, the upper tube 41 of pumping member 39 (FIGS. 3 and 4) is terminated by an annular end edge 42 at right angles with the longitudinal axis of distributor 38 and member 39, said edge 42 being located just below the interior 43 of the outlet portion 27 of the discharge duct 26, said end edge 42 constituting the seat of the expulsion valve 42 and 44. The latter has as its flap a flexible disk 44 of thickness 0.3 mm outside said central zone, whereby the periphery of disk 44 has an intermediate external diameter between the internal and external diameters of the end 42 of upper tube 41, is kept bearing on edge 42 via a central longitudinal rod 45, whose top end is itself locked by the bottom of the bearing web 250 of actuator 160. On its lower face, bearing web 250 carries a small centring tube 46, in which is fitted the top end of the central bearing rod 45. Flexible disk 44 and its rod 45 are integral with one another and with the pumping member 39, the bottom of disk 44 being connected to the upper tube 41 by flexible connecting means consisting of a central lug 47 on the bottom of disk 44 and three flexible retaining rings at 120° from one another such as 48 and 48' (incompletely shown), of cross-section 1×0.6 mm and inclination 30° towards the top in the free state (FIG. 4) starting from lug 47 and attached to the interior of tube 41, just below the end 42 thereof. As fitted and in the inoperative state, i.e. without actuator bearing, the flexible disk 44 is horizontal or slightly hollowed out towards its center, whilst its periphery bears tightly with the pasty product on the end edge 42. Comments will be made on the oepration of said expulsion valve 42, 44 in connection with FIG. 5.

The suction valve 40 of distributor 38 (FIG. 3) designated C2 in the tests, differs from valve 7 or C1 of the control distributors 1 and 32 by its underlying portion 49, which has 12 regularly spaced radial reliefs such as 50, 50', 50'', whose longitudinal edges such as 51, of overall diameter 21 mm, serve as guidance means for the valve 40 in the diameter 22 mm orifice 5, as well as a circular contour retaining ring 52 supported by reliefs 50 and of substantially semicircular cross-section. The closing web 53 of valve 40 has a central hollowed-out zone 54, the bottom of said zone 54 being at intermediate height of the passage windows of the pasty product defined by the annular rim 55 of web 53, the reliefs such as 50 and 50' and the circular retaining ring 52, which facilitates the passage of the pasty product through valve 40 whilst still permitting an improved crushing of the pumping member 39 (FIG. 5). The axial travel of valve 40 in orifice 5 is 3 mm, like that of valve 7.

The left-hand part of FIG. 5 shows the arrangement of the complex pumping member 39 and valve 40 of FIG. 3. The situation is that at the end of the suction phase, the pumping member 39 having roughly reassumed its initial shape, the bearing on the actuator web 250 being released. The periphery of the flexible disk 44 has elastically reassumed its shape and bears on the end 42 of the upper tube 41 of the pumping member 39, closing the top of the pumping or compression chamber 56 defined by said pumping member. Arrow 57 indicates the radial path of the pasty product between two reliefs 50, 50' and then on passing through the opening gap of the annular rim 55 of the valve. The passage of the pasty product through the central orifice 5 is of the direct multi-radial type.

The right-hand half of FIG. 5 shows the same pumping member 39 at the end of compression. Its deformable web 20 has folded back in glovefinger-like manner between the more rigid lower and upper tubes 41 and its upper fold 58 abuts against the closing web 53 of valve 40 at the top of its central hollowed-out zone 54. The geometry of zone 54 can be modified in order to permit a more marked weighing down or deflection of the pumping member 39. Compression of chamber 56 brings about the expulsion of the pasty product between the terminal edge 42 of upper tube 41 and the flexible disk 44, whose periphery is curved in and whereby said expulsion is indicated by arrow 59. Valve 40 is closed, its web 53 being applied by pressure to the annular surface 6.

FIG. 6 shows the same valve 40 moulded at the same time as the rest of the top 3 of tubular body 2 of distributor 38 on its cylindrical skirt 4, the bottom of its circular retaining ring being connected to the top of orifice 5 of top 3 by a breakable plastics ring 60 of approximate thickness 0.15 mm and width 0.6 to 0.8 mm. The downward thrust of valve 40 leads to the breaking of ring 60 and the ratching of retaining ring 52 below orifice 5.

Figure 7:
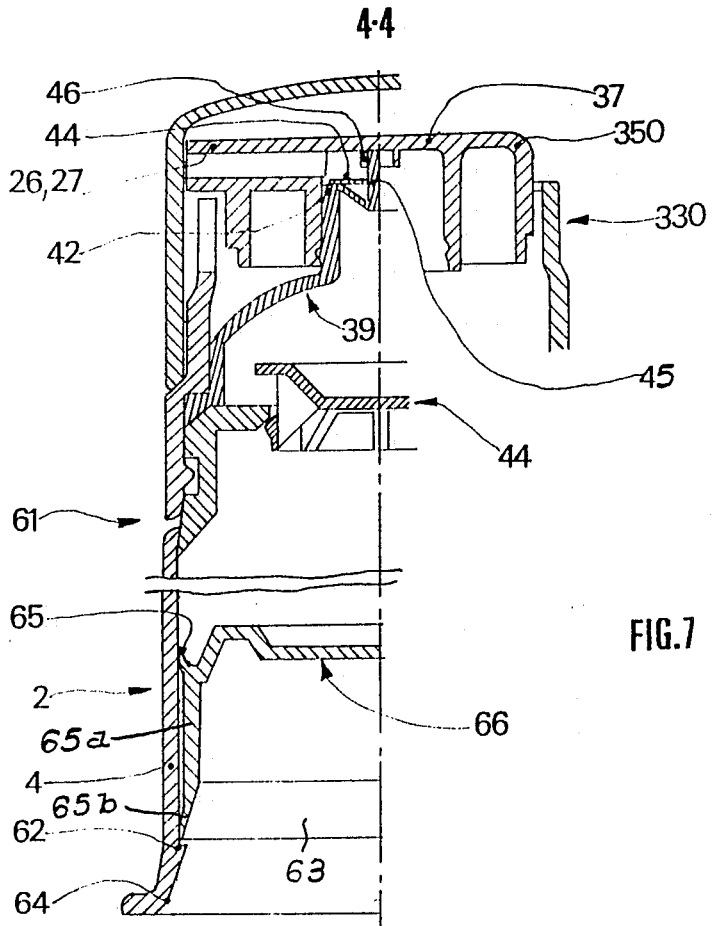
FIG. 7 shows a second distributor according to the invention with an actuator having an axial plunger and lateral distribution, the plunger being shown in axial section and the other members in longitudinal half-section.

The second distributor according to the invention 61 (FIG. 7) only differs from the first distributor 38 according to the invention (FIG. 3) by its actuator 330 having a plunger 350 identical to the actuator of the second control distributor 32 (FIG. 2) with the exception of a small central tube 46 below the bearing web 37 of plunger 350, which keeps the central bearing rod 45 of flexible disk 44 of pumping member 39 as in distributor 38. FIG. 7 shows the lower part of tubular body 2 which has, at the bottom of the circular cylindrical skirt 4 of internal diameter 33 mm, an internal relief 62 of minimum internal diameter 32.2 mm, preceded by a widened inlet zone 63 of cone half-angle 15° and height 4 mm, with an engagement diameter 64 of the flexible, widened, upper lip 65 of the sliding piston 66 of 34 mm. This transverse relief 62 has two effects, namely the escape of air occluded between the piston and the pasty product during the introduction of piston 66, as a result of the residual transverse undulation of the flexible lip 65 of piston 66 due to its introduction restriction and the prevention of the downward retraction of the piston (inviolability). Such a relief is present in the other distributors according to the invention, i.e. 38 and 67. The sliding piston 66 includes a rigid median part 65*a* set back with respect to the inner surface of the skirt 4 and a lower, semi-rigid, widened guide end 65*b* sliding with a limited clearance or with slight force within the skirt 4.

Figure 8:
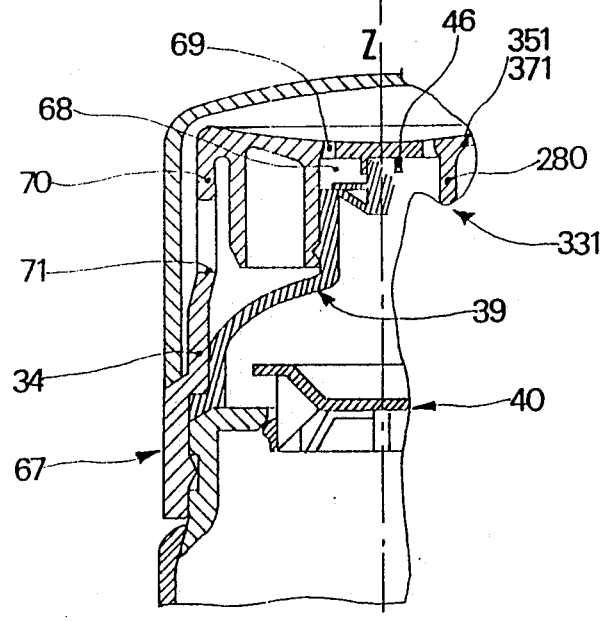
FIG. 8 shows a third distributor according to the invention having an actuator with an axial plunger and outlet orifices carried by the bearing web of the plunger, in longitudinal axial half-section.

The third distributor according to the invention 67 (FIG. 8) differs from the second distributor 61, in that the distribution pipe 68 of its plunger 351 essentially comprises the bottom part of the longitudinal shaft 280 carried by the bottom of the bearing web 371 of plunger 351, said web 371 having six orifices 69 of diameter 1.5 mm and regularly spaced externally of said small centring tube 46 and located between a circle of diameter 10 mm centred on the longitudinal axis Z and the bottom diameter 13 mm of shaft 280. Said distributor 67 is used as a fixed or placed distribution pot, actuated with one hand and in the present case the plunger 35 has a lateral driving-in abutment 70, the cutout 71 of the outer tubular part 34 of actuator 331 regulating the insertion of said abutment 70.

DISTRIBUTOR OPERATING TESTS

All the tests were performed with the same pasty product, namely a toothpaste. The expulsion forces and the return times indicated in table 1 correspond to 20 tests for each of the cases a to d and for each actuator type (tilting actuator or axial plunger). There are two tests in each of the cases e.

The control expulsion valve T is valve 22 and 25 or 22 and 37, of control distributors 1 and 32 and the suction valve C1 is valve 7 of the distributors tested in case a.

The expulsion valve Inv. is that 42 and 44 of the first two distributors according to the invention 38 and 61 mounted either with the valve 40 C2 as in the examples, or with the valve 70 C1 and with one or other of the two polyester ether tubular pumping members 39 having a thickness of deformable web 20 of respectively 0.9 and 0.75 mm.

TABLE 1

| | Distributor operating tests: expulsion force (bearing on actuator) and return time. | | | | |
|---|---|---|---|---|---|
| CASE | EXPULSION VALVE | SUCTION VALVE | DEFORMABLE WEB THICKNESS (mm) | TILTING ACTUATOR | AXIAL PLUNGER |
| a | T | C1 | 0.9 | 2.5 kg (2 to 3 s) | 4.5 kg (2 to 3 s) |
| b | Inv. | C1 | 0.9 | 1.6–1.7 kg (2 to 3 s) | 2.5 to 2.7 kg (2 to 3 s) |
| c | Inv. | C1 | 0.75 | 1.2 kg (12 to 18 s) | 1.6 kg (12 to 18 s) |
| d | Inv. | C2 | 0.75 | 1.2 kg (2 to 3 s) | 1.6 kg (2 to 3 s) |
| e | Inv. | C2 | 0.9 | 1.6 kg (1.5 s) | 2.5 kg (2.2 s) |

The results give rise to the following comments:

The effect of the novel expulsion valve on the reduction of the expulsion force is very significant, cf. cases a and b.

The reduction of the thickness of the deformable web of the pumping member 39 from 0.9 to 0.75 mm has decreased its resistance to "glovefinger folding" (FIG. 5), but also its spring effect. Results c show that the force has further decreased, particularly for the axial plunger, but that the return is much longer (too soft).

Results d and e show that the use of the novel suction valve with respect to the deformable web thickness of 0.9 mm has only had an effect on the return time of the tilting actuator and that for the two actuator types it compensates and eliminates to a surprising extent the very significant increase in the return time noted with the reduced thickness (0.75 mm) of the deformable web.

In the present case, a satisfactory situation is arrived at through the use in combined manner of the novel expulsion valve and the novel suction valve for each of the two tested actuator types.

I claim:

1. A pasty product distributor comprising:

a tubular body, a distribution head fixed to the tubular body, and a piston tightly slidable in the tubular body for movement toward said distribution head; said distribution head including:

pumping means for the pasty product, in addition to said sliding piston, incorporating a deformable tubular pumping member, a distribution duct extending therefrom, an expulsion valve between said pumping member and said distribution duct for expelling the pasty product from said pumping member into said distribution duct and an actuator acting on said pumping member;

said pumping member having a base fixed with respect to the tubular body, a deformable part above said base and an upper tube, said expulsion valve having a member defined by the upper end of said upper tube of said pumping member;

the distribution duct for the pasty product communicating with said pumping member, said upper end of the upper tube of the deformable pumping member having an annular end edge, said expulsion valve including a flexible disk, having a periphery bearing against the end edge of the tube, and said disk having a central bearing means, said bearing means being linked with the actuator, wherein said flexible disk and said end edge of the tube respectively form a flap and a seat of said expulsion valve.

2. The distributor according to claim 1, wherein said central bearing means of the flexible disk is a longitudinal rod, and central means carried by said actuator for maintaining said rod.

3. The distributor according to claim 2, wherein said flexible disk and said longitudinal rod are integral with the pumping member, and flexible connecting means connecting the bottom of the flexible disk to the interior of the upper tube of the pumping member.

4. The distributor according to claim 3, wherein said flexible disk has, outside a central zone, a thickness between 0.15 and 0.45 mm, and said pumping member being formed of a polymer selected from the group consisting of thermoplastic polymers, silicon resins, natural rubber and artificial rubbers.

5. The distributor according to any one of claims 1, 2 and 3 wherein said piston sliding within said tubular body comprises a flexible, widened, upper lip ensuring the necessary sealing for the pasty product, a rigid median part set back with respect to the inner surface of said tubular body and a lower, semi-rigid, widened, guide end sliding with a limited clearance or slight forcing within said tubular body, said tubular body including air leak means operable during insertion of said piston into the tubular body up to contact with the pasty product contained therein, said air leak means comprising a transverse internal relief located at the bottom of said tubular body and of minimum internal diameter smaller by 0.3 to 1.5 mm than the internal diameter of the tubular body, a widened inlet zone of said relief of internal diameter decreasing from an engagement diameter at least equal to the external diameter in the free state of said flexible upper lip of said piston to said minimum internal diameter of said relief, and wherein the external diameter of said median part of said piston is at least 0.3 mm smaller than the minimum internal diameter of said relief.

6. The distributor according to claim 1, wherein said tubular body has a top defining a passage orifice surrounded by an annular surface, a suction valve for sucking the pasty product into a compression chamber defined by said pumping member, said annular surface comprising a seat of said suction valve, an upper web comprising the flap of said suction valve, said upper web having an annular rim for sealing said annular surface in a closing position of said suction valve, said upper web having an underlying portion engaged in said passage orifice and provided with at least one guiding relief having retaining means with an overall diameter larger by 0.4 to 2 mm than the diameter of said passage orifice.

7. The distributor according to claim 6, wherein said actuator comprises a fixed part having an external skirt fixed to the top of said tubular body and an inclinable central part connected to said fixed part and having a bearing web with said distribution duct therebelow, said distribution duct having an outlet portion, and a longitudinal shaft communicating with said portion, said longitudinal shaft being carried by the bottom of the bearing web and tightly fitting said upper tube of the pumping member.

8. The distributor according to claim 6, wherein said one or more reliefs comprise multiple spaced reliefs with longitudinal external edges to serve as guidance means for the suction valve flap in the passage orifice, said reliefs permitting passage between them of the pasty product and their overall diameter being smaller by 0.3 to 1.5 mm and the diameter of the passage orifice.

9. The distributor according to claim 8, wherein the retaining means is a substantially circular retaining ring carried by the lower part of said external edges of the spaced reliefs.

10. The distributor according to claim 9, wherein the upper web of said suction valve flap has a depressed central zone, the bottom of which is at an intermediate height relative to product passage windows defined between said upper web and said retaining ring.

11. The distributor according to claim 10, wherein the retaining ring has an external diameter larger by 0.5 to 1 mm than the diameter of the passage orifice of the top of said tubular body and whereof the longitudinal external edges of the spaced reliefs have an overall diameter smaller by 0.3 to 0.8 mm than said diameter of said passage orifice.

12. The distributor according to claim 6, wherein said actuator comprises an outer tubular part fixed to the top of the tubular body and a plunger sliding axially and rotatable within said outer tubular part, said plunger carrying a lateral abutment and said tubular part having an upper edge preventing the driving in of the plunger when said lateral abutment engages said upper edge, at least one cutout in said outer tubular part for receiving and engaging said lateral abutment therein upon an axial sliding of said plunger, said cutout limiting movement of said plunger, said plunger having a bearing web and beneath said bearing web said distribution duct having a longitudinal shaft carried by the bottom of said bearing web and sealingly fixed to said upper tube of the deformable pumping member, wherein said plunger acting on the pumping member forms an elastic, spring effect means cooperating with said plunger.

13. The distributor according to claim 12, wherein the distribution duct has an outlet portion connected to said longitudinal shaft, and said outlet portion having a lateral outlet for forming said lateral abutment of the plunger.

14. The distributor according to claim 13, wherein said distribution duct comprises the bottom part of said longitudinal shaft, and the bearing web of said plunger having at least one outlet port for the pasty product.

15. A deformable tubular pumping member comprising:

a lower tube with a lower fixing rim thereabout, a deformable dome-shaped web extending from said lower tube, and an upper tube extending from said dome-shaped web carrying a means for securement of the upper tube in a tubular member, said upper tube terminating in an annular edge and carrying a flexible disk connected to the interior of the upper tube by flexible means, said disk carrying a longitudinal central rod, enabling maintenance of the periphery of the flexible disk in tight engagement with said annular edge of said upper tube by manipulation of said longitudinal central rod.

* * * * *

UNITED STATES PATENT AND TRADEMARK OFFICE

CERTIFICATE OF CORRECTION

PATENT NO. : 4,962,870

DATED : October 16, 1990

INVENTOR(S) : Bernard Schneider

It is certified that error appears in the above-identified patent and that said Letters Patent is hereby corrected as shown below:

Column 12, line 27, change "13" to --12--.

Signed and Sealed this

Fourth Day of February, 1992

*Attest:*

HARRY F. MANBECK, JR.

*Attesting Officer*

*Commissioner of Patents and Trademarks*